US007381090B2

(12) United States Patent
Sakamoto et al.

(10) Patent No.: US 7,381,090 B2
(45) Date of Patent: Jun. 3, 2008

(54) CONNECTOR

(75) Inventors: Nobuyuki Sakamoto, Shizuoka (JP); Kazuki Zaitsu, Shizuoka (JP); Keiko Azuma, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/785,634

(22) Filed: Apr. 19, 2007

(65) Prior Publication Data

US 2007/0249223 A1 Oct. 25, 2007

(30) Foreign Application Priority Data

Apr. 24, 2006 (JP) ..... 2006-119888

(51) Int. Cl.
*H01R 13/40* (2006.01)

(52) U.S. Cl. ..... 439/587

(58) Field of Classification Search ..... 439/587, 439/272–275, 552

See application file for complete search history.

(56) References Cited

U.S. PATENT DOCUMENTS 5,766,039 A * 6/1998 Abe ..... 439/587
5,865,636 A * 2/1999 Myer et al. ..... 439/275
6,517,389 B2 * 2/2003 Sato ..... 439/701
6,984,149 B2 * 1/2006 Fukuda et al. ..... 439/587
2005/0106916 A1 * 5/2005 Nomura ..... 439/275

FOREIGN PATENT DOCUMENTS

JP 2000-294336 10/2000
JP 2004-349072 12/2004

* cited by examiner

*Primary Examiner*—Briggitte R. Hammond
(74) *Attorney, Agent, or Firm*—Kratz, Quintos & Hanson, LLP

(57) ABSTRACT

A connector having a sealing function, which can be disassembled and also assembled easily, is provided. The connector includes: a connector housing which receives a terminal fitting attached to an end of an electric wire; a sealing member which includes sealing pieces made of resilient material positioning the electric wire between the sealing pieces and a holding means holding the sealing pieces at predetermined positions; and an outer housing which receives the connector housing and the sealing member, wherein the sealing pieces maintain a waterproof characteristic between the outer housing and the electric wire when the connector housing and the sealing member are received in the outer housing.

2 Claims, 9 Drawing Sheets

CONNECTOR

BACKGROUND OF THE INVENTION (1) Field of the Invention

The present invention relates to a connector for connecting electric wires or the like, which maintain waterproof characteristic between the connector and the electric wire.

(2) Description of the Related Art

Various electronic instruments are mounted on a motor vehicle as a mobile unit. The motor vehicle is equipped with a wiring harness for transmitting electric power and control signals to the electronic instruments. The wiring harness includes a plurality of electric wires and connectors. The electric wire is a so-called coated electric wire including an electrically conductive core wire and an electrically insulating coating which coats the core wire.

For example, a connector disclosed in Japanese Patent Application Laid-Open No. 2000-294336 is used as the connector described above. The connector disclosed in Japanese Patent Application Laid-Open No. 2000-294336 includes a connector housing and sealing member. The connector housing includes a tube-shaped outer housing and a plurality of plate-shaped housings. The plate-shaped housing is provided with a terminal receiving groove for receiving a terminal fitting to which an electric wire is attached.

The sealing member includes a plurality of sheet-shaped sealing pieces made of resilient material such as rubber. The sheet-shaped sealing piece is attached to the plate-shaped housing so as to maintain a waterproof characteristic between the sheet-shaped sealing piece and the electric wire attached to the terminal fitting received in the terminal receiving groove of the plate-shaped housing.

The connector described above is assembled as follows: The terminal fitting with an electric wire is received in the terminal receiving groove of the plate-shaped housing and the sheet-shaped sealing piece is attached to the plate-shaped housing. Then, the plate-shaped housings are laminated with each other and thus laminated plate-shaped housings are received in the outer housing. Thus, the connector having a structure as described above is assembled and is coupled with a mating connector. In the connector thus assembled, the sheet-shaped sealing piece maintains waterproof characteristic between the sheet-shaped sealing piece and the electric wire so as to prevent liquid such as water from entering into the terminal receiving groove by way of the electric wire.

A connector disclosed in Japanese Patent Application Laid-Open No. 2004-349072 uses a sealing material such as urethane foam instead of using the sheet-shaped sealing piece disclosed in Japanese Patent Application Laid-Open No. 2000-294336. When the connector is assembled, the terminal fitting with an electric wire is received in the terminal receiving groove of the plate-shaped housing, the plate-shaped housings are laminated with each other, and the laminated plate-shaped housings are received in the outer housing and thereafter, a sealing material filling tank provided in the outer housing is filled with the sealing material.

As for the connector disclosed in Japanese Patent Application Laid-Open No. 2000-294336, when the plate-shaped housings are assembled with each other, the sheet-shaped sealing pieces made of rubber or the like abut against each other. Therefore, the plate-shaped housings must be assembled with each other resisting against resilient restoring force of the sheet-shaped sealing piece. Further, as for the connector disclosed in Japanese Patent Application Laid-Open No. 2000-294336, the plate-shaped housing is not provided with any means for fixing the sheet-shaped sealing piece. Therefore, when the plate-shaped housings are assembled with each other, the sheet-shaped sealing piece might possibly come off from the plate-shaped housing due to the restoring force of the sheet-shaped sealing piece. Therefore, as for the connector disclosed in Japanese Patent Application Laid-Open No. 2000-294336, it is difficult to assemble the plate-shaped housings without coming-off of the sheet-shaped sealing piece, resulting in that the connector is difficult to be assembled.

As for the connector disclosed in Japanese Patent Application Laid-Open No. 2004-349072, its assembly characteristic is good, however, if the sealing material subjected to the filling-up is once hardened, the maintenance cannot be performed since the sealing material cannot be separated from the outer housing. Further, since there are many controlling items for the sealing material, therefore there is a problem that the control of the sealing material is not easy.

SUMMARY OF THE INVENTION

It is therefore an objective of the present invention to solve the above problems and to provide a connector having a sealing function, which can be disassembled and also assembled easily.

In order to attain the above objective, the present invention is to provide a connector including: a connector housing which receives a terminal fitting attached to an end of an electric wire; a sealing member which includes sealing pieces made of resilient material positioning the electric wire between the sealing pieces and a holding means holding the sealing pieces at predetermined positions; and an outer housing which receives the connector housing and the sealing member, wherein the sealing pieces maintain a waterproof characteristic between the outer housing and the electric wire when the connector housing and the sealing member are received in the outer housing.

With the construction described above, even if resilient restoring force of the sealing piece takes place when the electric wires and the sealing pieces are assembled with each other, the sealing pieces can be held at respective predetermined positions, therefore the electric wires and the sealing pieces can be easily assembled with each other. That is, the connector can be easily assembled. Further, since the sealing pieces can be positioned at the respective predetermined positions, therefore the sealing piece never comes off from the corresponding electric wire and the sealing pieces can press the electric wires with uniform force.

The holding means includes an engaging element made of synthetic resin formed integrally with the corresponding sealing piece and a frame part having a mating engaging element engaging with the engaging element, the mating engaging elements being arranged along a laminating direction of the sealing pieces.

With the construction described above, since the electric wires and the sealing pieces are assembled with each other while the sealing pieces, which are laminated putting the electric wire therebetween, are fixed to the frame part, therefore the connector can be easily assembled.

The connector housing includes a plurality of plate-shaped housings and is assembled by laminating a plurality of the plate-shaped housings with each other.

With the construction described above, instead of putting the sealing piece between the plate-shaped housings, the electric wires can be assembled with the sealing pieces in such a manner that the sealing pieces put the electric wire, which is pulled out from the plate-shaped housing, therebetween. Therefore, the connector housing can be easily assembled and the connector housing can be prevented from being enlarged in a laminating direction of the plate-shaped housings.

DESCRIPTION OF THE PREFERRED EMBODIMENTS

In the following, a connector according to the first preferred embodiment of the present invention will be explained with reference to FIGS. 1-6.

Figure 1:
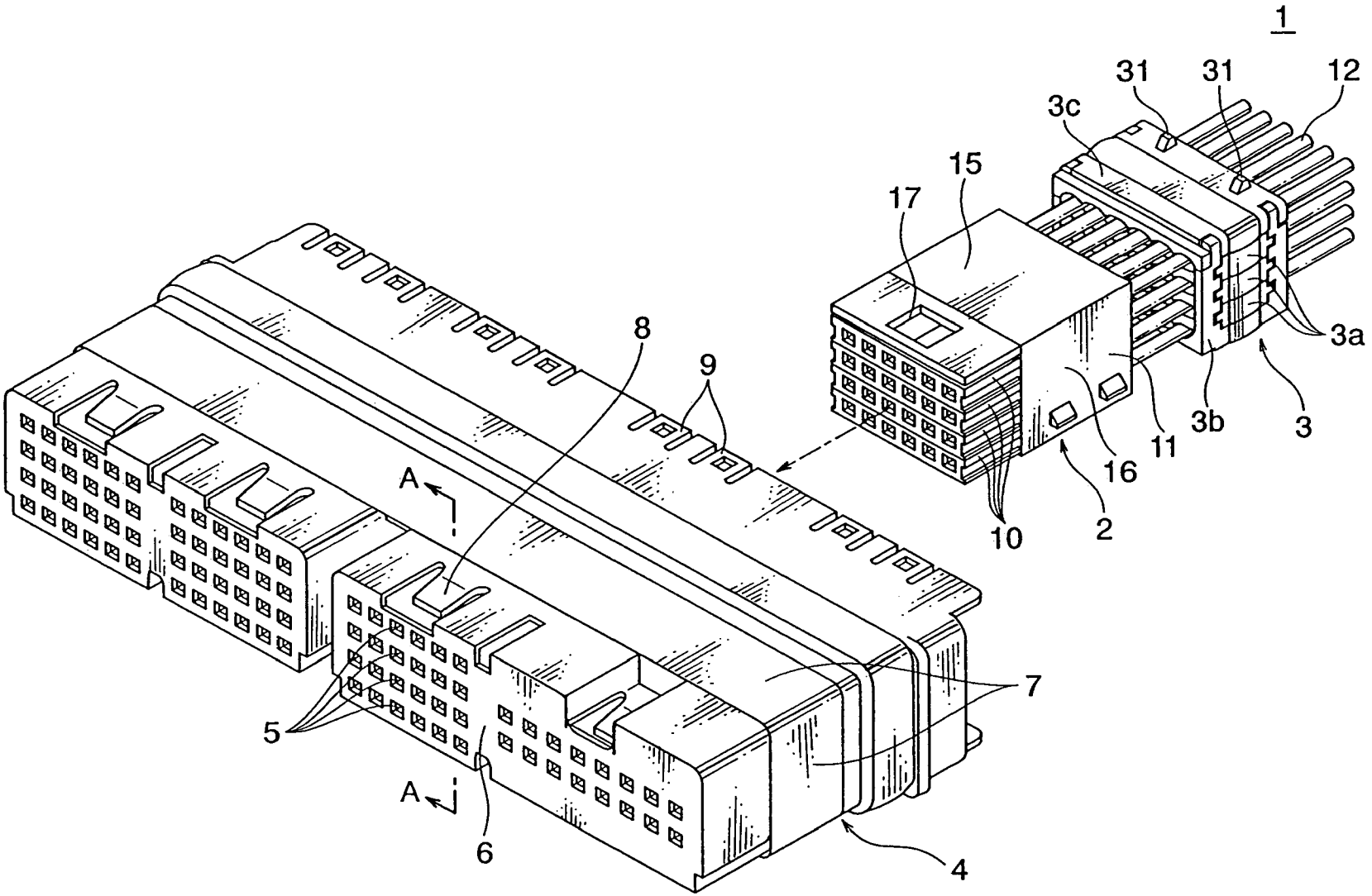
FIG. 1 is an exploded perspective view of a connector according to the first preferred embodiment of the present invention.
Figure 2:
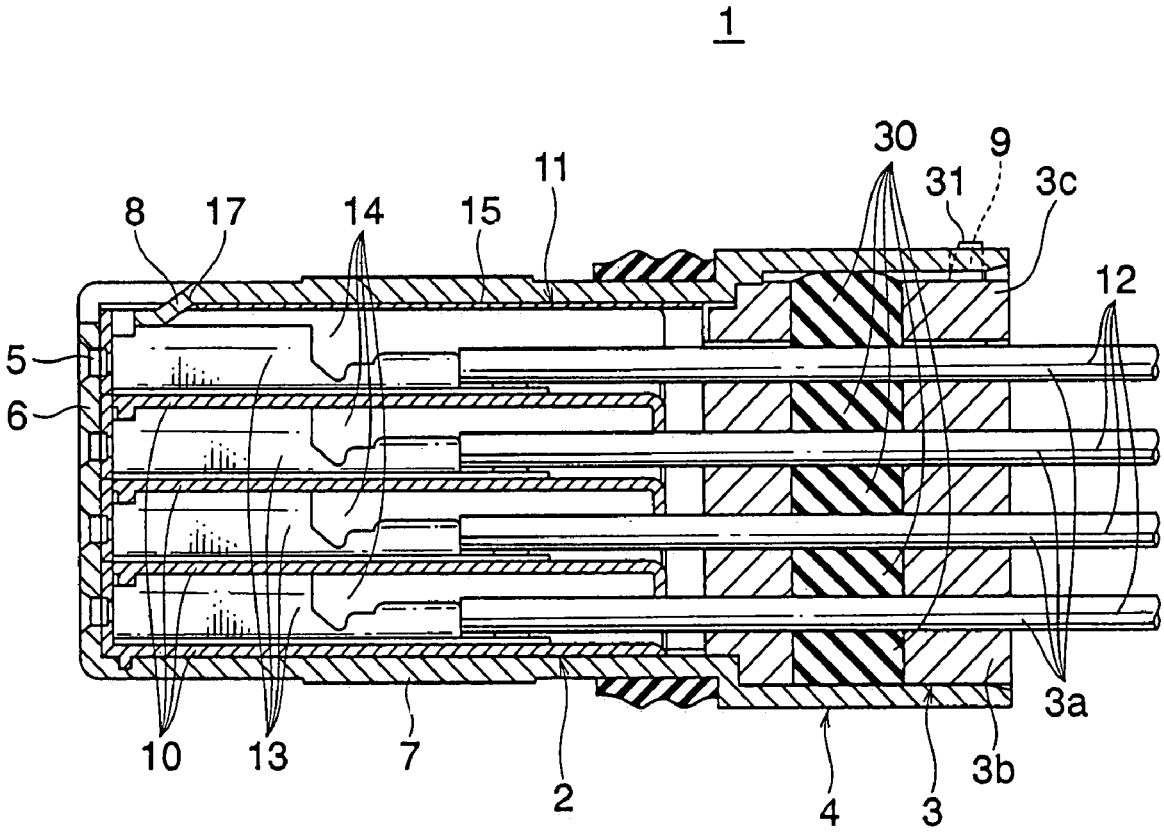
FIG. 2 is a cross sectional view taken along A-A line in FIG. 1.

As shown in FIGS. 1 and 2, the connector 1 includes an outer housing 4, a plurality of connector housings 2, and a plurality of sealing pieces 3.

The outer housing 4 is made of electrically insulating synthetic resin and formed in a tube-shape. The outer housing 4 includes a facing wall 6 having a plurality of holes 5 for passing male tabs of male terminals of a mating connector, with which the connector is coupled, and a plurality of peripheral walls 7 rising up from an outer edge of the facing wall 6. The peripheral walls 7 are provided with engaging claws 8 engaging with respective engaging holes 17 of a cover member 11 (explained later on) of the connector housings 2 and locking arms 9 engaging with locking projections 31 of ceiling plates 3*c* (explained later on) of the sealing member 3. A space inside the outer housing 4 is divided into plural parts (into four parts in an example shown in the figure).

In the example shown in the figure, there are four connector housings 2, although only one connector housing 2 is shown in the figure. As shown in FIGS. 1 and 2, the connector housing 2 includes a plurality of plate-shaped housings 10 and one cover member 11. In the example shown in the figure, one connector housing 2 is provided with four plate-shaped housings 10.

The plate-shaped housing 10 is made of electrically insulating synthetic resin and formed in a flat plate-shape. The plate-shaped housing 10 is provided with a plurality of terminal receiving grooves 14 which receive terminal fittings 13 (FIG. 2). Each terminal receiving groove 14 is formed concave from an outer surface of the plate-shaped housing 10. The terminal receiving grooves 14 are arranged in parallel to each other. A plurality of the plate-shaped housings 10 are laminated in parallel with each other.

The cover member 11 is made of electrically insulating synthetic resin and formed in a C-shape. The cover member 11 includes a flat ceiling wall 15 and a rising-up wall 16 rising up from an outer edge of the ceiling wall 15. The cover member 11 is laminated on the plate-shaped housing 10 in such a manner that the ceiling wall 15 closes the terminal receiving groove 14 of one plate-shaped housing 10 situated at the highest among a plurality of the plate-shaped housings 10, and positions a plurality of the plate-shaped housings 10 between a pair of the rising-up walls 16, thereby cover member 11 is fixed to the plate-shaped housings 10. The ceiling wall 15 is provided with the engaging holes 17 which engage with the engaging claws 8 of the outer housing 4.

Thus, in the connector housing 2, the plate-shaped housings 10, which receive the terminal fittings 13 attaching the electric wires 12 in the respective terminal receiving grooves, are laminated with each other, the plate-shaped housings 10 are covered with the cover member 11, and the plate-shaped housings 10 and cover member 11 are fixed to each other, so that the connector housing 2 is assembled.

Figure 3:
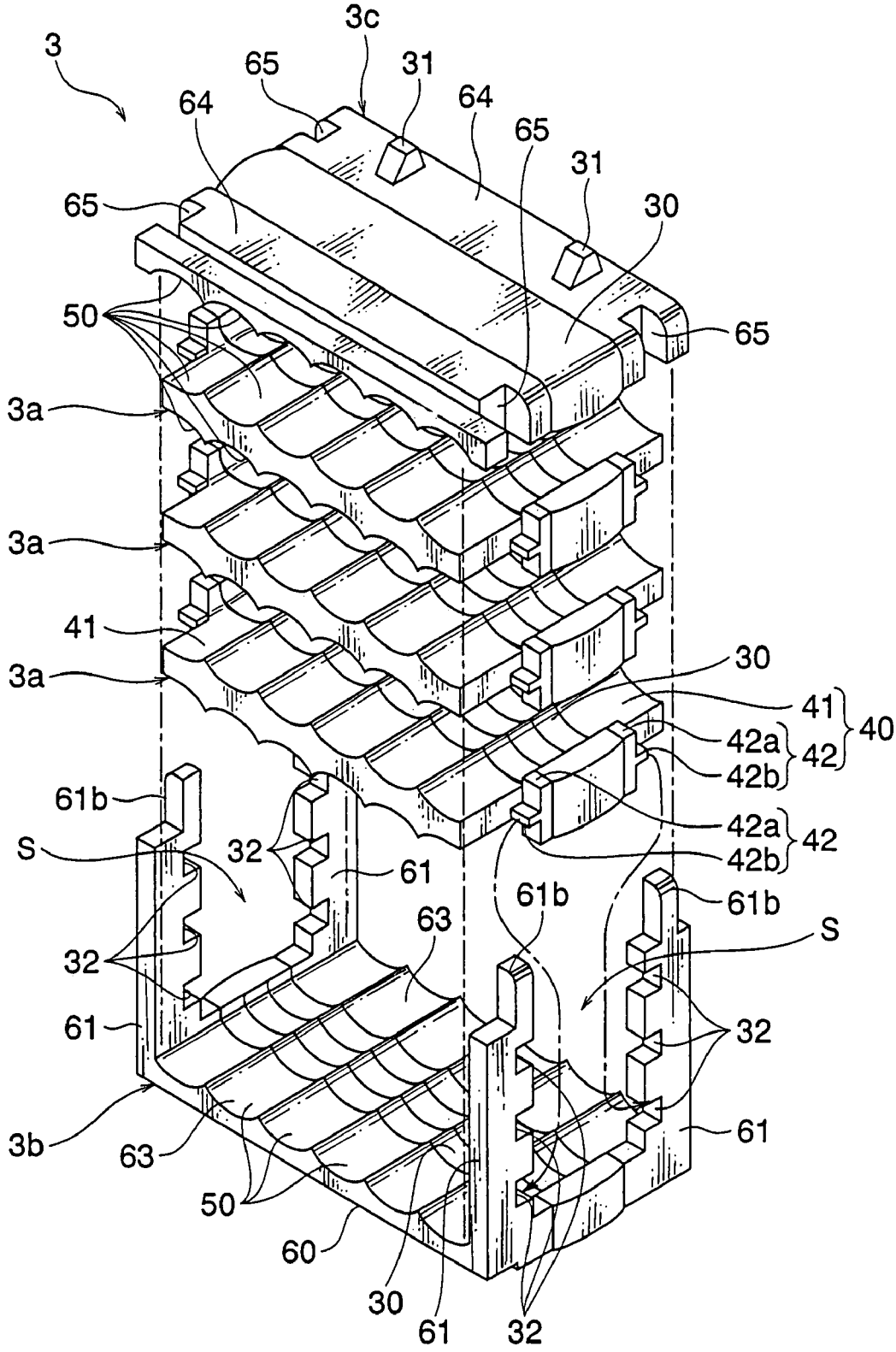
FIG. 3 is an exploded perspective view of a sealing member of the connector shown in FIG. 1.

In the example shown in the figure, there are four sealing members 3, although only one sealing member 3 is shown in the figure. As shown in FIG. 3, the sealing member 3 includes a sealing plate 3*a* formed in a plate-shape, a frame part 3*b* as the holding means, and a ceiling plate 3*c* formed in a plate-shape.

Figure 4:
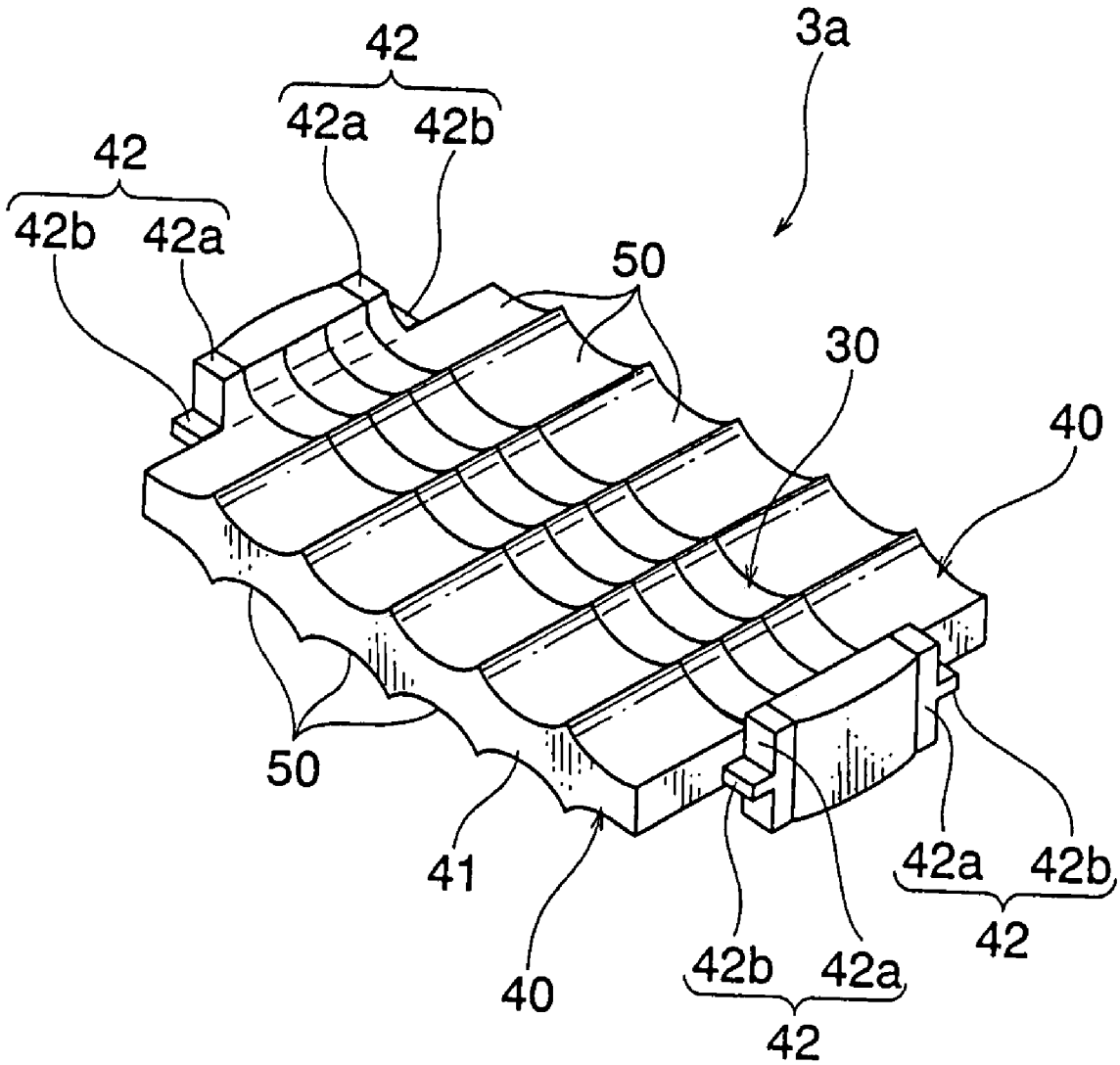
FIG. 4 is a perspective view illustrating a sealing piece of the sealing member shown in FIG. 3 and an engaging element formed integrally with the sealing piece.
Figure 5:
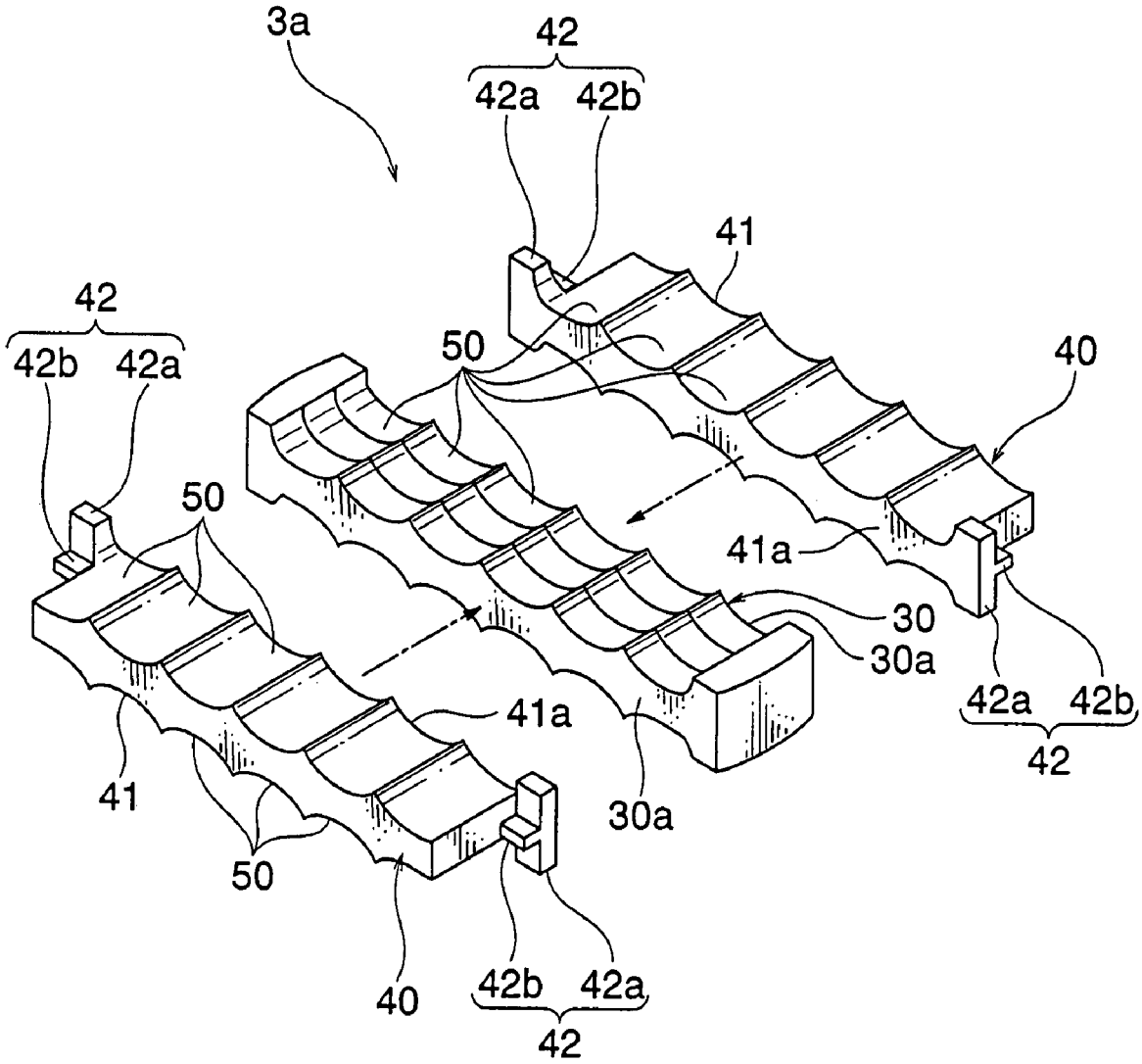
FIG. 5 is an exploded perspective view of the sealing piece and the engaging element shown in FIG. 4.

In the example shown in the figure, there are three sealing plates 3*a*. As shown in FIG. 2, the sealing plates 3*a* are laminated along a laminating direction of the plate-shaped housings 10 and arranged between the electric wires 12 attached to the terminal fittings 13 received in the terminal receiving grooves 14 of the plate-shaped housings 10. As shown in FIGS. 4 and 5, the sealing piece 30 and a pair of holders 40 are integrated with each other, thereby forming the sealing plate 3*a*.

As shown in FIG. 5, the sealing piece 30 is made of resilient material such as rubber and formed in a bar-shape. The holder 40 is glued to both side surfaces 30*a* in the width direction of the sealing piece 30. The width direction of the sealing piece 30 means a direction parallel to a longitudinal direction of the electric wire 12 to be laminated with the sealing piece 30.

As shown in FIG. 5, the holder is made of electrically insulating and solid (i.e. hardly being resiliently deformed) synthetic resin and includes a body part 41 formed in a bar-shape and a pair of engaging parts 42 as the holding means formed at both ends in the longitudinal direction of the body part 41. One side surface 41*a* in the width direction of the body part 41 is glued to the side surface 30*a* at an end in the longitudinal direction of the sealing piece 30 with an adhesive.

The engaging part 42 includes an engaging body 42*a* and a projection 42*b*. The engaging body 42*a* is glued to a side surface 30*a* in the longitudinal direction of the sealing piece 30 so as to be formed integrally with the sealing piece 30. The projection 42*b* rises up from the engaging body 42*a* and extends in a direction leaving the side surface 30*a*. That is, the projection 42*b* is arranged in a direction crossing at right angles the side surface 30*a*. The projection 42*b* engages with an engaging groove 32 (explained later on) as the mating engaging element of the frame part 3*b*. The engaging part 42 is formed integrally with the body part 41.

The sealing plate 3*a* includes a plurality of grooves 50 on both surfaces in the thickness direction (i.e. the laminating direction of the sealing plates 3) of the sealing plate 3*a*. The groove is formed concave from the surface in an arc-shape in section. A plurality of grooves 50 are arranged in parallel to each other along the longitudinal direction of the sealing piece 30 and the holder 40. The groove 50 extends straight along the width direction of the sealing piece 30 and the holder 40. The electric wire 12 is positioned within the groove 50.

As shown in FIG. 3, the frame part 3*b* includes a bottom plate 60 arranged in parallel to the sealing plate 3*a* (i.e. laminated with the sealing plate 3*a*) and four rising-up plates 61. The bottom plate 60 has approximately the same construction as that of the sealing plate 3*a* and glued to a second holder 63 made of synthetic resin formed on both side surfaces 30*a* in the width direction of the sealing piece 30 by an adhesive. On a surface of the bottom plate 60 facing the sealing plate 3*a*, a plurality of the grooves 50 are arranged along the longitudinal direction of the sealing piece 30 and the second holder 63 (i.e. longitudinal direction of the bottom plate 60). The electric wire 12 is positioned between the bottom plate 60 and the sealing plate 3*a*.

The rising-up plate 61 continues to the second holder 63 and arranged at four corners of the bottom plate 60 and rises up from a surface, which faces the sealing plate 3*a* of the bottom plate 60, in the laminating direction of the bottom plate 60 and the sealing plate 3*a*. Each rising-up plate 61 is formed in a plate-shape extending straight. The rising-up plates 61 are arranged in parallel to each other having a distance therebetween. An end of the sealing plate 3*a* in the longitudinal direction of the sealing piece 30 and the engaging part 42 formed integrally with said end are positioned between the two rising-up plates 61 facing each other along the width direction of the bottom plate 60. (Hereinafter, a space formed between the two rising-up plates 61 is called space S as shown in FIG. 3.)

The rising-up plate 61 is provided with three projections 42*b* of the engaging part 42 and three engaging grooves 32 as the mating engaging elements engageable with the respective projections 42*b*. The engaging groove 32 is formed concave from a surface which faces the space S among surfaces of the rising-up plate 61. The engaging grooves 32 are lined up having a distance therebetween along the laminating direction of the bottom plate 60 and the sealing plates 3*a*.

As for the frame part 3*b*, the electric wire 32 passes through between two pairs of the rising-up plates 61 facing each other along the longitudinal direction of the bottom plate 60, and the sealing plates 3*a* are laminated inside the four rising-up plates 61. When the sealing plates 3*a* are laminated, an end in the longitudinal direction of the sealing piece 30 of the sealing plate 3*a* and the engaging part 42 formed integral with said end are press-fit into the space S. Then, the projection 42*b* of the engaging part 42 engages with the engaging groove 32, and the sealing piece 30 of the bottom plate 60 and the sealing piece 30 of the sealing plate 3*a* are compressed so as to press the electric wire 12 positioned between the sealing pieces 30. Thus, three sealing plates 3*a* are laminated in sequence and held at respective predetermined positions.

As shown in FIG. 3, the ceiling plate 3*c* has approximately the same construction as that of the bottom plate 60. A third holder 64 made of synthetic resin having approximately the same construction as that of the second holder 63 as described above is glued to both side surfaces 30*a* in the width direction of the sealing piece 30. The ceiling plate 3*c* is arranged in parallel to the sealing plate 3*a* (i.e. laminated on the sealing plate 3*a*) and assembled to the frame part 3*b* putting three sealing plates 3*a* between the ceiling plate 3*c* and the bottom plate 60. A surface of the ceiling plate 3*c* facing the sealing plate 3*a* is provided with a plurality of grooves 50 along the longitudinal direction of the sealing piece 30 and the third holder 64 (i.e. longitudinal direction of the ceiling plate 3*c*). The electric wire 12 is positioned between the ceiling plate 3*c* and the sealing plate 3*a*.

The ceiling plate 3*c* does not include an engaging means which engages with the frame part 3*b* like the engaging part 42 of the sealing plate 3*a*. The ceiling plate 3*c* is provided with a slit 65 at both ends in the longitudinal direction of the third holder 64. An end part 61*b* of the rising-up plate 61 passes through the slit 65, said end part 61*b* being situated away from the bottom plate 60, so that the ceiling plate 3*c* is assembled to the frame part 3*b*. However, the ceiling plate 3*c* is not fixed to the frame part 3*b*.

Further, a surface of the ceiling plate 3*c* is provided with two locking projections 31 engageable with the locking arm 9 of the outer housing 4, said surface being situated away from the sealing plate 3*a* of the third holder 64. The sealing member 3 is attached to the outer housing 4 so that the locking projection 31 engages with the locking arm 9, thereby the sealing piece 30 is compressed so as to press the electric wire 12 which is positioned between the ceiling plate 3*c* and the sealing plate 3*a*.

Thus, the electric wire 12 is positioned between the bottom wall 60 and the sealing plate 3*a*, between the sealing plate 3*a* and the other sealing plate 3*a*, and between the sealing plate 3*a* and the ceiling plate 3*c*, and further, the bottom wall 60, i.e. frame part 3*b*, the three sealing plates 3*a* and the ceiling plate 3*c* are laminated in sequence, thereby the sealing member 3 is assembled. The sealing member thus assembled is press-fit into the outer housing 4. When the sealing member 3 is attached to the outer housing 4, the sealing pieces 30 maintain a waterproof characteristic between the sealing piece 30 and the electric wire 12 and further, the sealing member 3 maintains a waterproof characteristic between the sealing member 3 and an inner surface of the outer housing 4.

Figure 6:
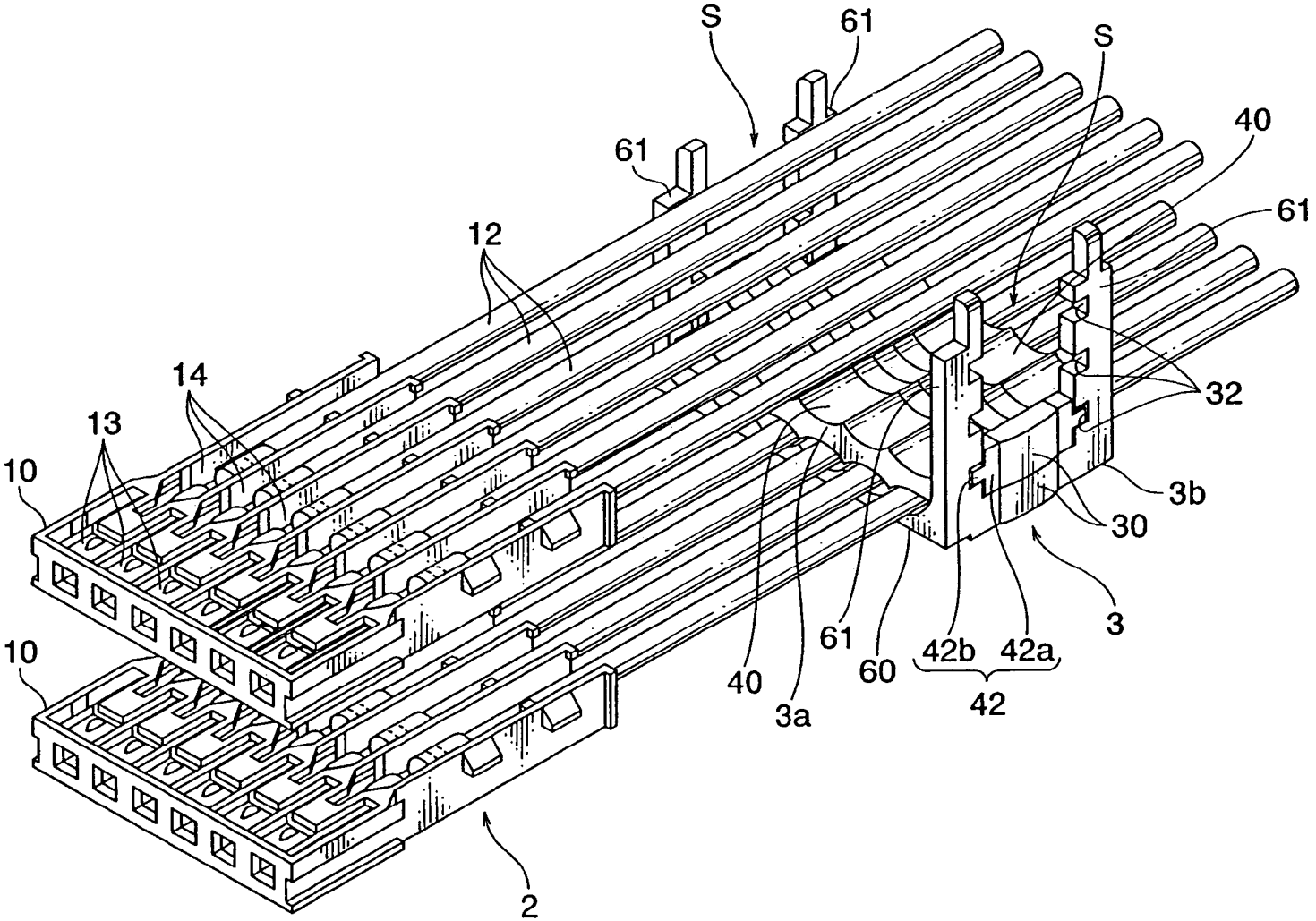
FIG. 6 illustrates a method of assembling the connector shown in FIG. 1.

The connector 1 described above is assembled as follows: first, each terminal fitting 13 having the electric wire 12 is press-fit into the terminal receiving groove 14 of the plate-shaped housing 10. Then, as shown in FIG. 6, the electric wires 12 are placed in the respective grooves 50 of the bottom plate 60 of the frame part 3*b*. Then, the sealing plate 3*a* is placed on the electric wire 12 of the plate-shaped housing 10 and the sealing plate 3*a* is pressed in a direction approaching the bottom plate 60 so as to engage the projection 42*b* with the engaging groove 32 of the frame part 3*b*. Then, the electric wire 12 of the other plate-shaped housing 10 is placed on this sealing plate 3*a*. Thus, the bottom plate 60 of the frame part 3*b*, the three sealing plates 3*a*, the ceiling plate 3*c* and the plate-shaped housings 10 are laminated with each other, thereby assembling the sealing member 3.

Thereafter, the cover member 11 is assembled to a plurality of the plate-shaped housings 10 laminated with each other so as to fix a plurality of the plate-shaped housings 10 to each other, thereby assembling the connector housing 2. After the connector housing 2 thus assembled is inserted into the outer housing 4, the assembled sealing members 3 are press-fit into the outer housing 4. Then, the locking projection 31 of the sealing member 3 engages with the locking arm 9 of the outer housing 4, so that the sealing pieces 30 of the sealing member 3 maintains a waterproof characteristic between the sealing piece 30 and the electric wire 12 and a waterproof characteristic between the sealing member 3 and the inner surface of the outer housing 4, thereby the connector 1 is assembled.

The connector 1 thus assembled is coupled with a mating connector, thereby constructing a wiring harness to be mounted on a motor vehicle or the like.

According to the preferred embodiment described above, when the electric wires 12 and the sealing plates 3*a* having the sealing pieces 30 are assembled to each other, each sealing plate 3*a* is assembled while being fixed to the frame part 3*b*, so that the sealing plates 3*a* can be held at the respective predetermined positions. Therefore, the electric wires 12 and the sealing plates 3*a* can be easily assembled to each other. Therefore, the connector 1 can be easily assembled. Further, since the sealing plates 3*a*, that is, the sealing pieces 30 can be held at the respective predetermined positions, therefore the sealing pieces 30 can press the electric wires 12 with uniform force preventing the electric wires 12 from coming off.

By using the sealing members 3, the assembling can be carried out on a condition that the electric wires 12 guided out from the plate-shaped connector housings 10 are nipped without putting the sealing piece 30 between the plate-shaped housings 10. Therefore, the connector housing 2 can be easily assembled without enlarging the connector housing 2 in the laminating direction of the plate-shaped housings 10.

In the preferred embodiment described above, the sealing pieces 30 are glued to the holders 40, 63, 64 with an adhesive. However, instead, the sealing pieces 30 may be molded integrally with the holders 40, 63, 64 by insert molding.

In the following, a connector according to the second preferred embodiment of the present invention will be explained with reference to FIGS. 7-9.

Figure 7:
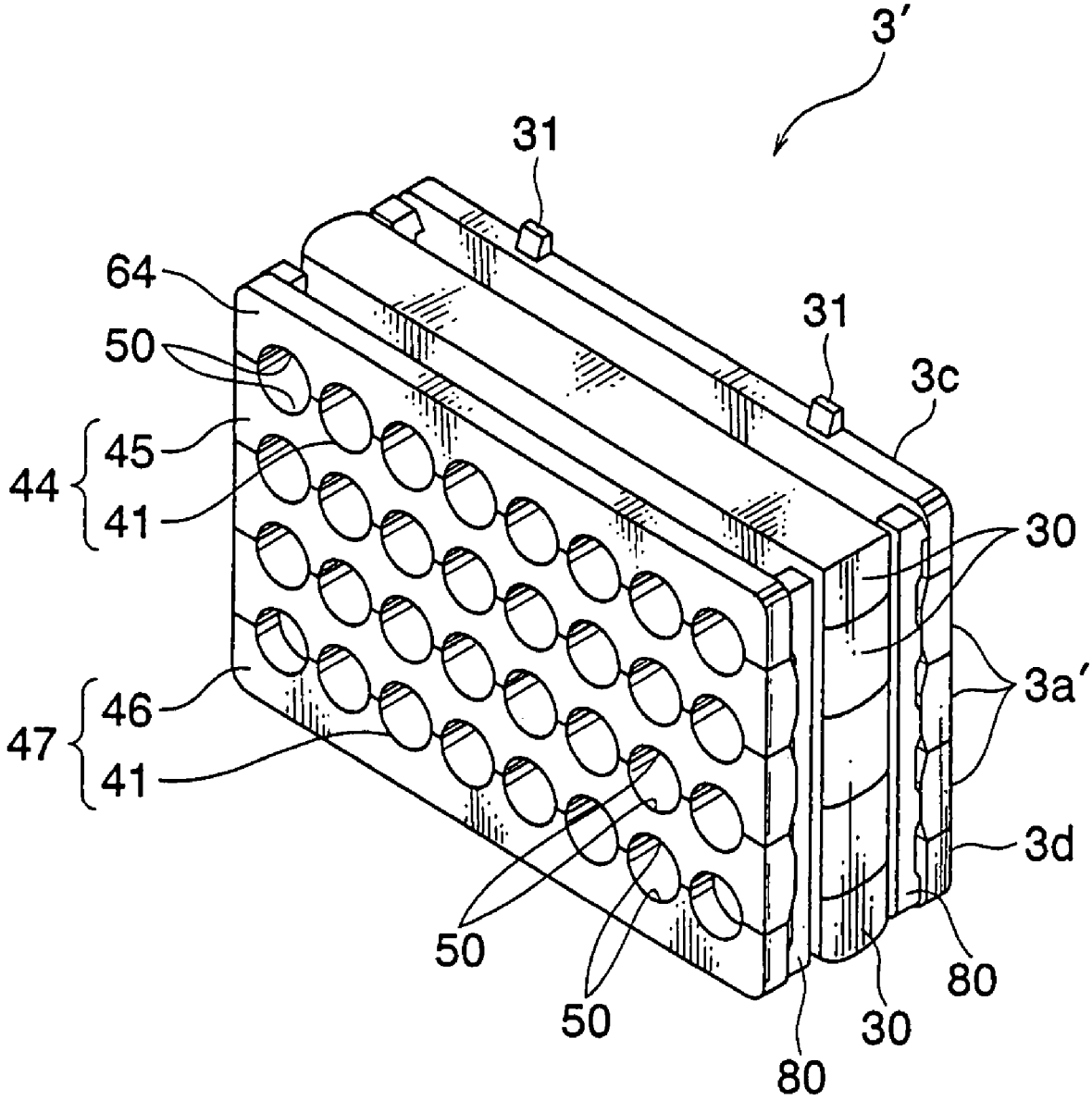
FIG. 7 is a perspective view of a sealing member of a connector according to the second preferred embodiment of the present invention.

The connector includes a sealing member 3' shown in FIG. 7. As shown in FIGS. 7 and 8, the sealing member 3' includes three sealing plates 3*a*', sealing plate 3*d* placed below the three sealing plates 3*a*' shown in FIG. 8, ceiling plate 3*c* placed above the three sealing plates 3*a*' shown in FIG. 8, and two frame parts 80 as the holding means.

Each sealing plate 3*a*' includes a sealing piece 30 and a holder 44 made of synthetic resin glued to both side surfaces 30*a* (see FIG. 5) in the width direction of the sealing piece 30 with an adhesive. The holder 44 includes a body part 41 formed in a bar-shape and a pair of engaging parts 45 as the holding means provided at both end parts in the longitudinal direction of the body part 41.

Figure 8:
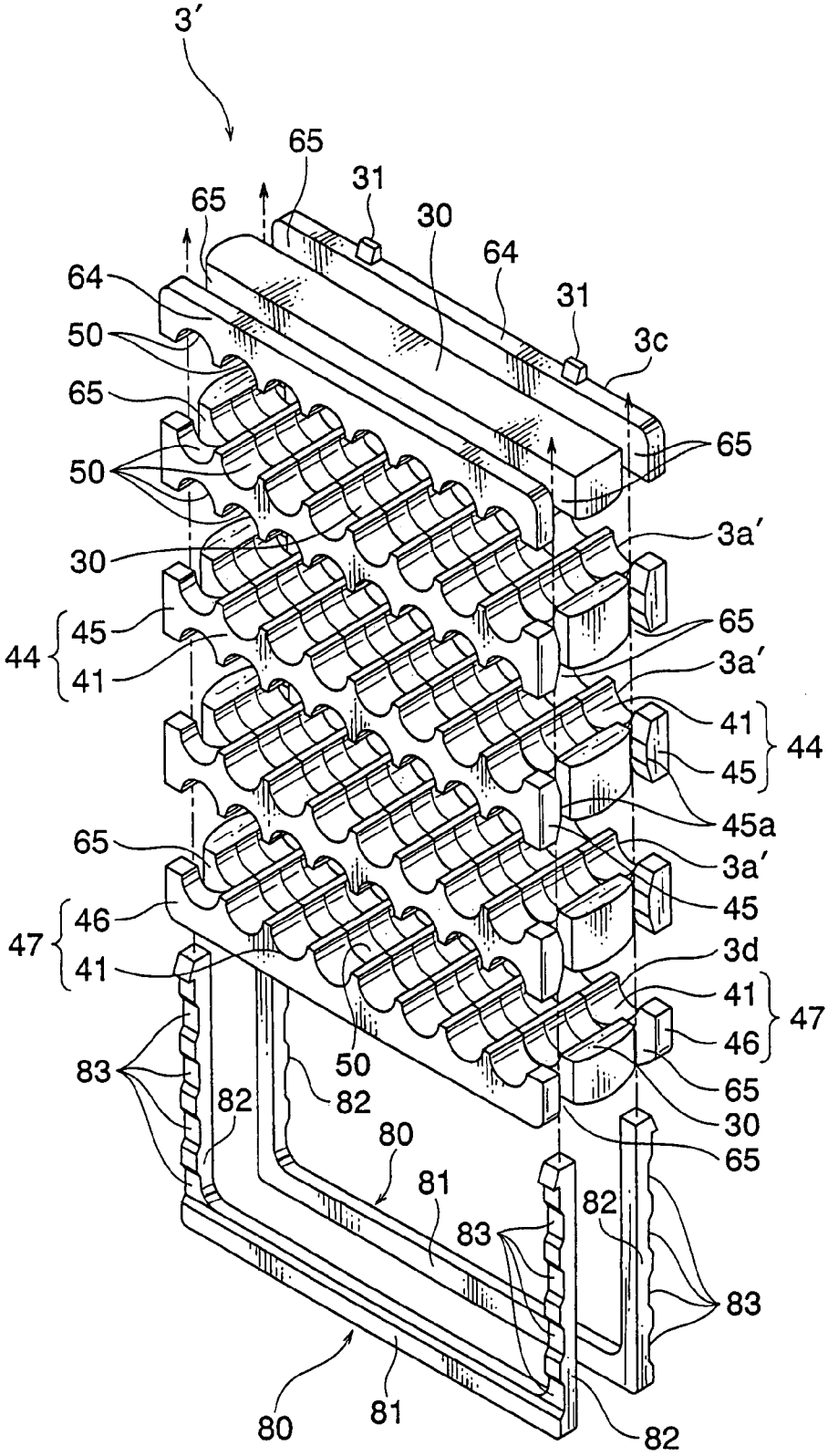
FIG. 8 is an exploded perspective view of the sealing member shown in FIG. 7.
Figure 9:
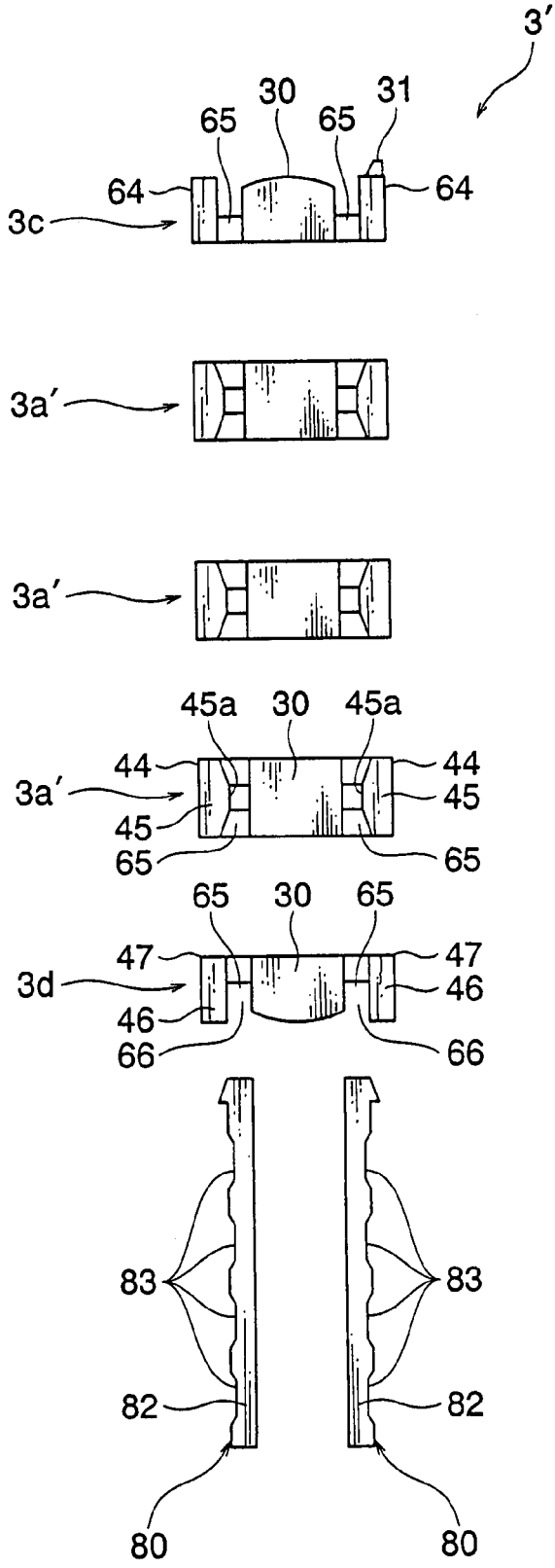
FIG. 9 is a side view of the sealing member shown in FIG. 8.

As shown in FIGS. 8 and 9, the engaging part 45 is an end part in the longitudinal direction of the body part 41 arranged having a distance between said end part and an end part in the longitudinal direction of the sealing piece 30 by providing a slit 65 at both end parts in the longitudinal direction of the body part 41. The engaging part 45 includes a projection 45*a* projecting from a surface of the engaging part 45 toward the sealing piece 30, said surface facing the sealing piece 30.

The sealing plate 3*d* includes a sealing piece 30 and a holder 47 made of synthetic resin glued to both side surfaces 30*a* (see FIG. 5) in the width direction of the sealing piece 30 with an adhesive. The holder 47 includes the body part 41 formed in a bar-shape and a pair of engaging parts 46 as the holding means provided at both end parts in the longitudinal direction of the body part 41.

As shown in FIGS. 8 and 9, the engaging part 46 is an end part in the longitudinal direction of the body part 41 arranged having a distance between said end part and an end part in the longitudinal direction of the sealing piece 30 by providing a slit 65 at both end parts in the longitudinal direction of the body part 41.

As shown in FIG. 9, the body part 41 of the holder 47 is provided with a slit 66 opening toward the side situated away from the sealing plate 3*a*'. The slit 66 is formed over the whole area in the longitudinal direction of the body part 41. Thereby, a part of the body part 41 situated away from the sealing plate 3*a*' has a distance between said part and the sealing piece 30.

The frame part 80 is made of electrically insulating synthetic resin. The frame part 80 is formed in a C-shape including a bar-shaped frame body 81 extending straight and a rising-up part 82 extending in a direction crossing at right angles the frame body 81 from both ends in the longitudinal direction of the frame body 81. The frame body 81 is inserted into the slit 66 of the sealing plate 3*d* so as to agree with the sealing plate 3*d*. The rising-up part 82 is inserted into the slit 65 of the sealing plate 3*a*', sealing plate 3*d* or the ceiling plate 3*c*.

The rising-up part 82 includes four engaging grooves 83 as the mating engaging elements formed concave from a surface which faces the engaging part 45, 46 on a condition that the rising-up part 82 is inserted in the slit 65. These engaging grooves 83 are lined up along the rising direction of the rising-up part 82. The engaging part 45, 46 is positioned in the engaging groove 83 on a condition that the rising-up part 82 is inserted in the slit 65. The projection 45*a* of the engaging part 45 agrees with the engaging groove 83.

The sealing member 3' is assembled as follows: First, the two frame bodies 81 of the frame parts 80 are inserted into the slits 66 and the rising-up parts 82 are inserted into the slits 65 of the sealing plate 3*d*, thereby assembling the frame parts 80 and the sealing plate 3*d* to each other. Then, the electric wires 12 are placed on a plurality of the grooves 50 of the sealing plate 3*d*. Then, the sealing plates 3*a*' are placed on the sealing plate 3*d* and the sealing plates 3*a*' are pressed in a direction approaching the sealing plate 3*d*. Then, the rising-up parts 82 are inserted into slits 65 of the sealing plates 3*a*' and the projections 45*a* of the engaging parts 45 agree with the engaging grooves 83, thereby the sealing plates 3*a*' are fixed to the frame bodies 81. That is, the sealing plates 3*a*' are held at respective predetermined positions. Thus, the other sealing plates 3*a*', ceiling plate 3*a* and electric wires 12 are laminated with each other, thereby assembling the sealing pieces 3'.

In the second preferred embodiment described above, two frame parts 80 are provided. However, at least one frame part 80 may be provided. The sealing pieces 30 are glued to the holders 44, 47 and 64 with an adhesive. However, instead, the sealing pieces 30 may be molded integrally with the holders 44, 47 and 64 by insert molding.

In the first and second preferred embodiments described above, the connector housing 2 is constructed by laminating the plate-shaped housings 10. However, instead, the connector housing may not be such a laminated-type connector housing.

The aforementioned preferred embodiments are described to aid in understanding the present invention and variations may be made by one skilled in the art without departing from the spirit and scope of the present invention.

What is claimed is:

1. A connector comprising:

a connector housing which receives a terminal fitting attached to an end of an electric wire;

a sealing member, which includes sealing pieces made of resilient material and a holding means holding the sealing pieces at predetermined positions, with the electric wire positioned between the sealing pieces; and an outer housing which receives the connector housing and the sealing member, wherein the holding means includes an engaging element made of synthetic resin, formed integrally with the corresponding sealing piece, and a frame part having a mating engaging element engaging with the engaging element, and wherein the sealing pieces maintain a waterproof characteristic between the outer housing and the electric wire when the connector housing and the sealing member are received in the outer housing.

2. The connector according to claim 1, wherein the connector housing includes a plurality of plate-shaped housings and is assembled by laminating a plurality of the plate-shaped housings with each other.

* * * * *